United States Patent [19]

Hoehn

[11] 4,390,313

[45] Jun. 28, 1983

[54] METHOD AND APPARATUS FOR DEPACKING ARTICLES

[76] Inventor: John W. Hoehn, 7 Webb St., Middle Brighton, Victoria, Australia

[21] Appl. No.: 247,274

[22] Filed: Mar. 25, 1981

[30] Foreign Application Priority Data

Mar. 27, 1980 [AU] Australia ..... 2942/80

[51] Int. Cl.[3] ..... B65B 43/26

[52] U.S. Cl. ..... 414/412; 53/381 R

[58] Field of Search ..... 414/412; 53/381 R, 384

[56] References Cited

U.S. PATENT DOCUMENTS 3,263,843 8/1966 Grahn ..... 414/412

3,889,442 6/1975 Grahn ..... 414/412 X 4,172,348 10/1979 Duerr ..... 53/381 R X

*Primary Examiner*—Richard A. Schacher

*Attorney, Agent, or Firm*—Bucknam and Archer

[57] ABSTRACT

A method and apparatus of removing articles from a package wherein the articles are arranged in a plurality of side by side rows and sealed in a film of thermoplastic material wherein the package is positioned with the rows of articles supported on a horizontal base, and then two longitudinal and two transverse tear lines or splits are formed in the upper surface extending substantially the full length and width of the package, a force is then applied to the portion of the thermoplastic material bound by the four tear lines or splits along a line in a plane passing between two adjacent rows of articles and that portion of the thermoplastic material is forced downwardly between the rows into contact with the under side of the package and thereafter said portion and a part of the under side of the package is forced downwardly through a slot in the base and all of the thermoplastic material of the package is withdrawn through said slot.

14 Claims, 4 Drawing Figures

METHOD AND APPARATUS FOR DEPACKING ARTICLES

It is a widely accepted practice to package a plurality of articles in an envelope of thermoplastic film or sheet material for convenience in handling and transporting. The thermoplastic material of the envelope is in a tensioned state so that the plurality of articles encased therein retain a pre-arranged formation during such handling and transportation.

In one use of this form of packaging unfilled containers are enclosed in an envelope of thermoplastic material immediately after manufacture of the containers so that the containers are not subject to subsequent contamination. In some instances the containers are of a moulded plastic construction, and are considered to be substantially sterile at the time of manufacture, and consequently are immediately assembled into a formation and wrapped within the envelope of thermoplastic material thereby maintaining the substantially sterile condition during subsequent handling and transportation.

Although this form of packaging does render handling and transporting of the articles such as containers convenient, it does present a problem in subsequently removing the thermoplastic envelope and arranging the articles therein for subsequent processing. Because of the flimsy nature of the envelope material, once it is split for the purposes of removing the articles from the package, there is a minimal restraint on movement of the articles, and thus they may readily depart from their row formation and also some or all may fall over into a different orientation. Accordingly it is then necessary to manually handle the containers to appropriately orientate them for subsequent processing into filling machines or the like. This of course involves additional costs, and also may lead to contamination of the articles, particularly if they are containers to be subsequently filled with material for human consumption.

It is therefore the principal object of the present invention to provide a method and apparatus for removing articles from a package of a type hereinafter defined, so that the articles are retained in the required relative disposition and orientation for subsequent processing.

With this object in view there is provided a method of removing articles from a package of the type hereinafter defined comprising positioning the package with the rows of articles supported on a horizontal base, forming two longitudinal and two transverse tear lines or splits in the upper wall of the package, said tear lines or splits extending substantially the full length and width of the package respectively, applying a force to portion of the thermoplastic material bound by the four tear lines or splits along a line in a plane passing between two adjacent rows of articles and aligned with a slot in the base, forcing said portion of the thermoplastic material downwardly between the rows into contact with the underside of the package, continuing the application of said force after establishment of said contact to force a part of said portion and a part of the underside of the package downwardly through said slot, and withdrawing all of the thermoplastic material of the package through said slot.

In the preceding paragraph, and throughout the specification, the word "package" means a plurality of articles arranged in a number of parallel rows to provide a rectangular formation, and sealed in an envelope of flexible thermoplastic material.

In the above described method the transverse and longitudinal tear lines or splits are preferably located so as to be substantially in respective planes between two respective adjacent rows of the articles. In these positions it is convenient to form the tear lines or splits without damage to the articles within the package.

Preferably slits are formed rather than tear lines although the slits may be interrupted at selected locations so that the area of thermoplastic material bounded by the slits will remain in position relative to the rest of the package until the force is applied thereto to force the material downwardly between the articles. The application of this force and the resultant movement of the portion of material bounded by the slits will result in severing of the small uncut sections of material.

It is preferable for the package to be located with rigid members extending along the respective sides of the package during the removal of the thermoplastic material to ensure that the movement of the thermoplastic material as it is withdrawn through the slot in the base does not cause undue movement of the articles out of their row formation or other dislodgement or reorientation of the articles.

The packages may be moved in a step wise motion along a predetermined path to first and second stations, with the slits or tear lines being applied at the first station, and the force being applied to the cut thermoplastic material to force it through the slot in the base at the second station. The withdrawal of the thermoplatic material through the slot may be achieved by a pair of rollers located beneath the horizontal base with the thermoplastic material being fed into the nip of the rollers by the vertical force. Once the material has entered between the rollers the rotation thereof will draw the remainder of the thermoplastic material away from around the assembly of articles through the slot, and preferably discharge it into a receptacle located beneath the rollers.

The forming of the tear lines or slits in the upper wall of the envelope may be carried out by one or a number of blades mounted on a movable head and may be pressed downwardly onto the package when located therebelow to form the slits or tear lines. Similarly the pressure may be applied to the central portion of the upper wall of the package, after the formation of the tear lines or slits, by a substantially vertical plate like member, also mounted on a head for up and down movement to force the thermoplastic sheet material through the slot in the base. The heads carrying the cutting members and the vertical plate may be mounted in a single frame, and the packages be moved in a step wise motion through the frame to be located in sequence below the cutting members, and then below the vertical plate. These two components may also be operated in timed relationship to the movement of the package through the frame.

There is also provided a machine for carrying out the above method comprising a base to support a package of the type hereindefined, means operable to form two longitudinal and two transverse slits or tear lines in the upper wall of the package, means to engage the portion of the package bound by said tear lines or slits and movable to force said portion downwardly between two rows of articles to engage the portion forming the underside of the package and force both portions of the package through a slot in a base supporting the package, and means to engage said portions of the package and draw the complete package from about the articles through said slot.

One practical arrangement of the invention will now be described with reference to the accompanying drawings. In the drawings.

Figure 1:
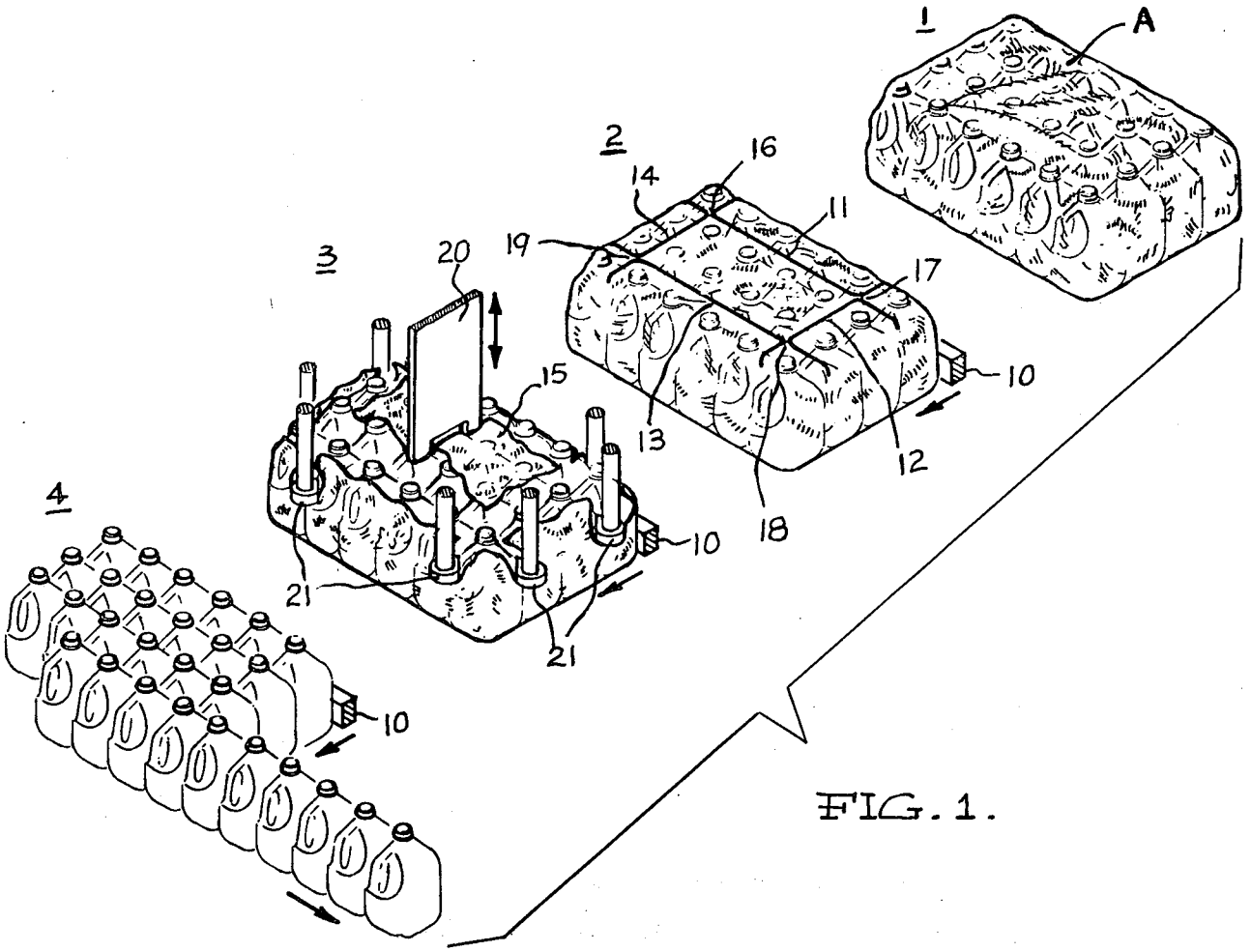
FIG. 1 is a schematic representation of the steps in removing the envelope of film from the assembly of containers.

Referring to FIG. 1, A indicates the assembly of articles in the form of twenty-four containers arranged in four parallel rows of six containers. The containers are enclosed in a sealed package formed of transparent thermoplastic material. The package is advanced in four stepwise movements in sequence through positions 1 to 4, such as by a bar 10 which forms part of an endless conveyor mechanism.

The package A is advanced from position 1 to position 2 wherein four continuous cuts 11, 12, 13 and 14 are made in the top surface of the package, each cut being of a generally U-shaped formation, with the base and the arms of the U each aligning with respective vertical planes passing between the longitudinal and transverse rows of containers. The four cuts result in the formation of a central panel 15 of the package material connected to the remainder of the package material by narrow strips 16, 17, 18 and 19.

The package, with the slits formed therein, is then advanced to position 3 in which, the blade 20 is lowered to engage the panel 15 along a line which passes between two adjacent rows of containers. At the same time, eight fingers 21, are lowered simultaneously with the blade 20, with the lower end of each finger engaging in the terminal portion of each of the arms of the four U-shaped slits. The blade 20 forces the panel 15 downwardly between the two adjacent rows of containers and this movement of the panel severs the four strips 16, 17, 18 and 19 from the remainder of the package material so that the panel is completely free thereof. The continued movement of the blade forces the panel 15 down between the rows of containers until it engages the package material on the underside of the containers, and still further continued movement of the blade forces both the panel 15 and the package material on the underside of the containers through the slot 25 in the base of the machine (as shown in FIG. 3) to enter between the counter-rotating rollers 26.

During the downward movement of the blade 20, the corresponding downward movement of the fingers 21 draws the remainder of the upper portion of the package down the sides of the assembly of containers so that, when the blade 20 engages the underside of the package and commences to force it through the slot 25, the remainder of the top portion of the package is clear of the top face of the containers so that it may be freely drawn from about the containers through the slot 25 by the rollers 26.

Thereafter the blade 20 and fingers 21 are withdrawn and the assembly of containers are advanced to position 4 by the bar 10 from which the containers can be withdrawn in a single row formation for delivery to subsequent processing machines, such as cleaning and filling machines.

Figure 2:
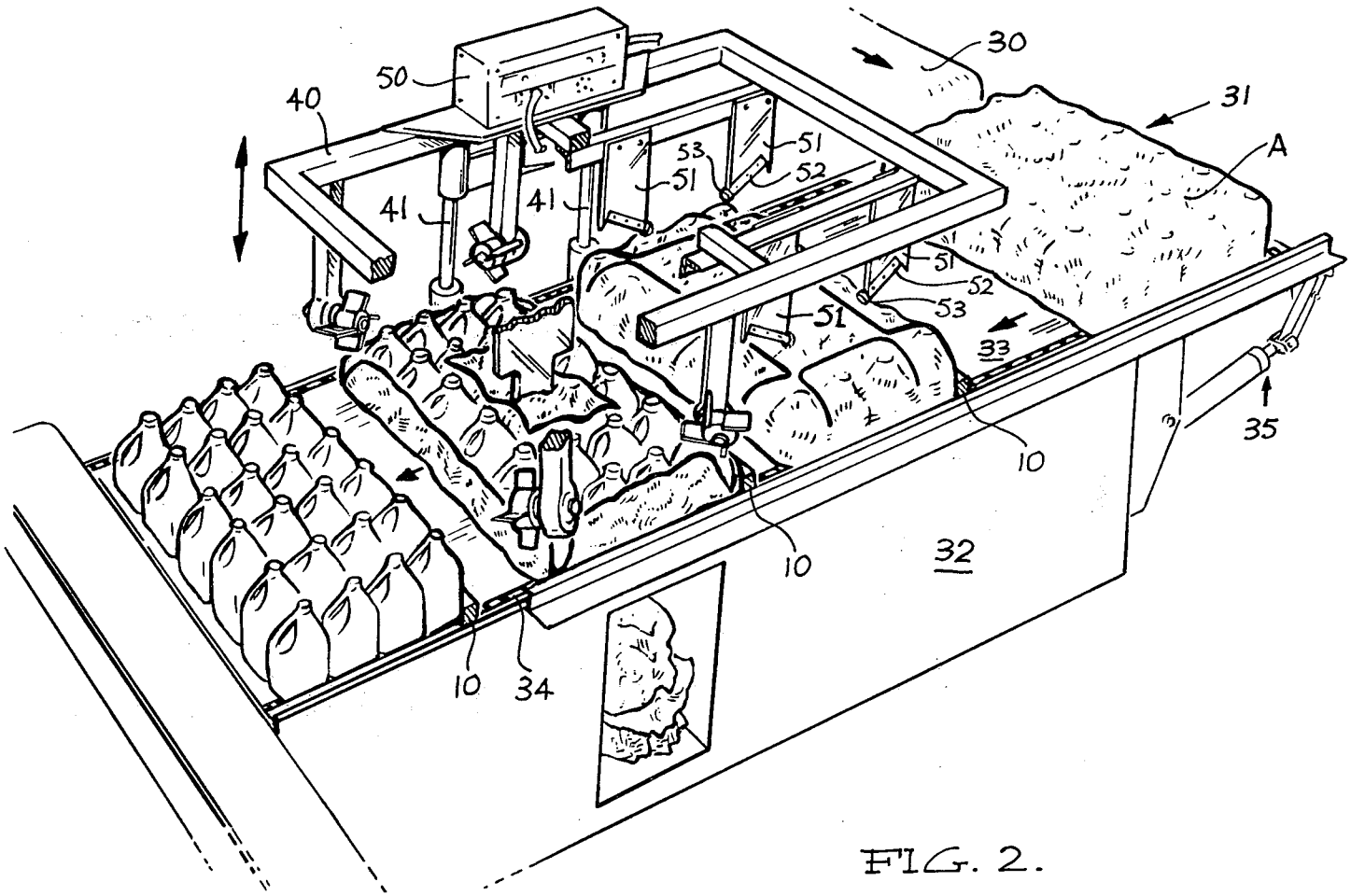
FIG. 2 is a perspective view of the apparatus for effecting the method of removing the envelope from the containers.
Figure 4:
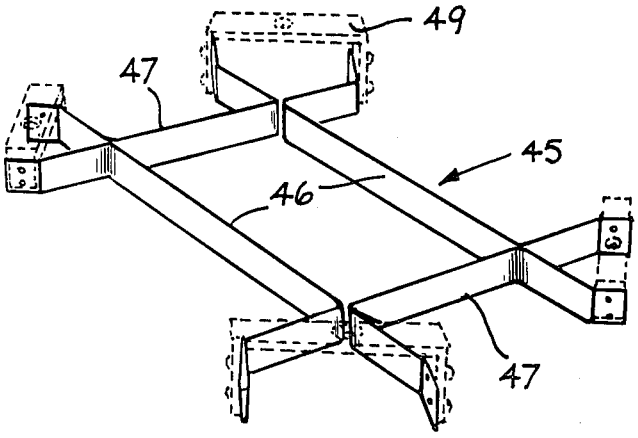
FIG. 4 is a diagrammatic drawing of the heater blades used in the apparatus shown in FIG. 2 to form the slots in the upper face of the envelope.
Figure 3:
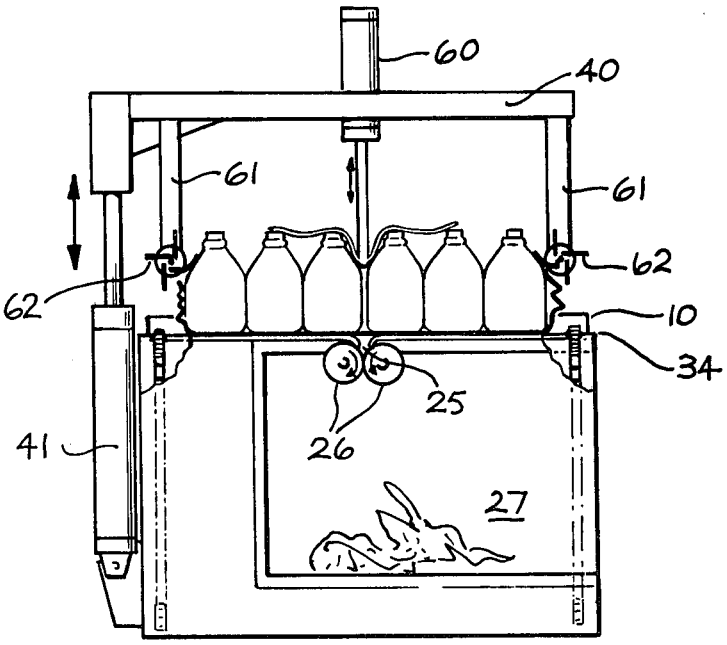
FIG. 3 is a sectional view along line 3—3 in FIG. 2.

Referring now to FIGS. 2 to 4 of the drawings there will be described an apparatus for carrying out the method of the present invention basically in accordance with the steps described with reference to FIG. 1 however the apparatus does include certain modifications from the particular equipment referred to in the description in reference to FIG. 1.

The packs of containers comprising 24 containers in the arrangement as described in reference to FIG. 1 are delivered by the conveyor 30 to a holding station 31 at one end of the machine, indicated generally at 32. The top face 33 of the machine 32 is flat so that the packages A of containers may freely slide therealong under the control of the conveyor mechanism having a plurality of transfer slats 34 spaced at a pitch equal to the pitch between the cutting position and extracting position on the machine 32 which correspond to positions 2 and 3 in FIG. 1. The pusher mechanism indicated diagrammatically at 35 moves the complete package of containers forward onto the surface 33 to be picked up by the bars 10 of the conveyor 34. The conveyor moves forward in a step-wise motion, the steps being controlled automatically to deliver one row of containers onto the discharge conveyor 37 during each of four step-wise movements. A fifth step is included in the sequence to provide a space between the packages in each position 2, the space having a width corresponding to the width of one row of containers. Accordingly five step-wise movements are required to advance a package of containers into position 2, a further five steps are required to advance the package from position 2 to position 3, and a final five step to deliver the four rows of containers to the conveyor 37.

The head frame 40 is supported in spaced relation above the upper face 33 of the machine by the two pneumatic cylinders 41. The hydraulic cylinders are secured rigidly to the machine base 32 and are operable to raise and lower to the head frame 40 as will hereinafter be described.

Carried by the head frame 40 is an arrangement of heater bars 45 which are shown for the purposes of clarity in FIG. 4 and not in FIG. 2. There are a pair of longitudinal U-shaped heater bars 46 and a pair of transverse heater bars 47. The heater bars are suspended from the head frame 40 by an arrangement of four corner brackets 48 which provide an insulation between the heater bars and the head frame 40 and between the respective heater bars. The heater bars are connected to a low voltage controlled electric power source 50 to maintain the heater bars during operation at a temperature sufficient to form slits in the thermoplastic film of the package when the heater bars are brought into contact therewith. The heater bars 46 and 47, arranged as illustrated in FIG. 4, will form a series of cuts 11, 12, 13 and 14, as described in respect of FIG. 1 when brought into contact with the film package.

The head frame 40 also carries a series of four knives 51. Each knife 51 is positioned so that when the head frame is lowered to bring the heater bars into contact with the film on the top of the pack the blades will form slits down the two opposite longitudinal sides of the pack between the respective corner containers and the next adjacent container in the longitudinal direction. As can be seen in FIG. 2 of the drawings the lower cutting edge 52 of the knives is inclined so that the lower inner end is the first part of the knife to make contact with the film and this lower end carries a small guide head 53 which will enter between the corner container and the next adjacent one, and hold them apart as the knife moved downwardly therebetween, and thus prevent the cutting edge contacting and damaging the wall of the container.

The head frame 40 carries in the area adjacent to that carrying the knives 51 and heater bars 45, a power cylinder 60 to which the blade 20 is attached. Also there are suspended from the head frame 40, four pillars 61 located so as to be adjacent to the four corners of the package when it is in position 3 below the blade 20. Mounted on the lower end of each pillar is an electric motor beater unit 62 having a plurality of flexible rubber beater blades. The beater units 62 are operated in timed relationship with the lowering of the frame 40, and rotate in a direction so that the blades of the beaters 62 contact the film of the package on each corner and induce a downward movement of the film along each corner containers of the package. This action of the beater units assists in freeing the film at the corners of the package from the corner containers, so that it may be more easily withdrawn from about the sides of the assembly of containers. The beater units are a substitute for the fingers 21 shown in FIG. 1.

As seen in FIG. 3 the top surface 33 of the machine has a slot 25 in alignment with the blade 20 so that when the blade is passed downwardly between the containers, carrying with it the top portion 15 of the package, it will upon engaging the underside of the package force the panel 15 and the underside portion of the film through the slot 25 in the top surface 33 into the nip of the rollers 26. The rollers 26 are driven by a suitable motor and rotated in the directions indicated in FIG. 3 so that the plastic film delivered into the nip of the rollers by the blade 20 is gripped by these rollers and withdrawn between the rollers into the receptical 27.

It will be appreciated, from the previous description of the equipment carried by the head frame 40, that during the downward movement of the head frame one package is operated upon by the heater bars 45 and knives 51 and simultaneously another package which has previously been subject to the operation of the heater bars and knives is now operated upon by the pusher blade 20 and beaters 62. The raising and lowering movement of the head frame 40 under the control of the hydraulic cylinders 41 is effected in timed relation to the step motion of the pusher bars 34 to correctly position the packages beneath the heater bars 45 and pusher blade 20 respectively.

The operation of the machine described above is basically as follows:

With a package of containers positioned on the top face of the machine 33, immediately below and in alignment with the heater bars 45, and the head frame in its raised position, electrical power is supplied from a control 50 to the heater bars and downward movement of the head frame 40 is commenced. As this downward movement proceeds the knives 51 and guide heads 53 penetrate the top surface of the film package between each corner container and the next adjacent container in the longitudinal direction.

The continued downward movement of the head frame causes the knives 51 to slit the film package down the two longitudinal sides whilst the corner container and the next adjacent containers are held apart by the guide head 53 to prevent damage thereto by the cutting edge 52. As the head frame reaches the lower limit of its travel the heater bars 46 and 47 contact the top surface of the package, and due to the temperature of the bars the top surface is split in accordance with the formation described in reference to FIG. 1 to form slits 11, 12, 13 and 14.

The head frame is now raised to its upper position and the conveyor operated to advance the package through five step-wise movements until it becomes centrally disposed beneath a pusher blade 20. The head frame is again lowered to bring the pusher blade 20 into contact with the central portion 15 of the top surface of a package and to bring the four corner beater units 62 into engagement with the respective corner portions of the package. The continuation of the downward movement of the head frame 40 causes the pusher blade 20 to force the portion 15 of the package film down between the two rows of containers as can be seen in FIG. 3 and for the beater units 62 to push the corner portions of the package film downwardly along the surface of the corner containers. The package film is shown in this pushed down condition in FIG. 2 although in that drawing the head frame 40 is raised and the beater units 62 are clear of the package.

Upon termination of the downward movement of the head frame 40 the power cylinder 60 is operated so as to force the pusher blade 20 downwardly further to bring it into contact with the portion of the package film beneath the containers. The continued movement of the blade 20 forces that portion of the pack, together with the portion 15, through the slot 25 in the top face 33 of the machine into the nip of the rollers 26. The revolving rollers thus grip the under portion of the package film and the panel 15 and withdraw the complete package film away from around the containers and delivers it into the bin 27.

It will be appreciated that whilst this operation has been in progress a further pack will have been positioned beneath the heater bars 45 and knives 51 and that pack will have been simultaneously subjected to the cutting and slitting operation as previously described.

The blade 20 is withdrawn by the power cylinder 60 and the head frame 40 is then raised. The conveyor again operates to move forwardly in a step-wise motion so that the assembly of containers freed from its package may be delivered to the conveyor 37 and the cut and slit package delivered beneath the pusher blade 20 for subsequent removal.

I claim:

1. A method of removing articles from a package having a plurality of said articles arranged in parallel rows to provide a rectangular formation and retained within an envelope of flexible thermoplastic material, said method comprising positioning the package with the rows of articles supported on a horizontal base, forming two longitudinal and two transverse tear lines or splits extending substantially the full length and width of the package respectively, applying a force to a portion of the thermoplastic material bound by the four tear lines or splits along a line in a plane passing between two adjacent rows of articles and aligned with a slot in the base, forcing said portion of the thermoplastic material downwardly between the rows into contact with an under side region of the thermoplastics material of the package, continuing the application of said force after establishment of said contact to force a part of said portion and a part of the under side region of the package downwardly through said slot, and withdrawing all of the thermoplastic material of the package through said slot.

2. A method as claimed in claim 1 wherein the respective longitudinal tear lines or slits are spaced inwardly from the respective longitudinal edges of the package a distance substantially equal to the width of a longitudinal row of objects.

3. A method as claimed in claim 1 wherein the respective transverse tear lines or slits are spaced inwardly from the respective transverse edges of the package a distance substantially equal to the width of a transverse row of objects.

4. A method as claimed in claim 1 wherein the tear lines or slits are formed by applying heated members to the upper wall of the package.

5. A method as claimed in claim 1 including forming an extension from each end of the transverse and/or longitudinal tear lines or slits down the respective sides of the package.

6. A method as claimed in claim 1 including promoting downward movement of the materials of the package at each of the vertical corners of the package at least prior to or during withdrawal of the underside of the package through the slot.

7. A machine for removing articles from a package having a plurality of said articles arranged in parallel rows to provide a rectangular formation and retained within an envelope of flexible thermoplastic material, said machine comprising a base to support a package of the type hereindefined, means operable to form two longitudinal and two transverse slits or tear lines in an upper wall of the package, means to engage the portion of the package bound by said tear lines or slits and movable to force said portion downwardly between two of said parallel rows of articles to engage a portion of the thermoplastics material forming an underside of the package and force both portions of the package through a slot in the base supporting the package, and means to engage said portions of the package and draw the complete package from about the articles through said slot.

8. A machine as claimed in claim 7 wherein the means to form the tear lines or slits comprise a plurality of members arranged in a formation so the lower edges thereof define a pattern corresponding to the required pattern of said lines or slits, said members being adapted to form said lines or slits in the upper wall of the package upon being brought into contact therewith, and means to effect relative movement between said member and the package to establish said contact.

9. A machine as claimed in claim 8 wherein means are provided to heat said members so that the lines or slits are formed by melting of the thermoplastic material of the package when the members contact the upper wall.

10. A machine as claimed in claim 7 including means to form slits in the side walls of the package, said slits being extensions of one or more of the tear lines or slits in the upper wall.

11. A machine as claimed in claim 7, wherein the means to engage the portion of the upper wall defined by the tear lines or slits comprise a vertically disposed plate-like member mounted for movement in the plane thereof relative to the package to pass between two adjacent rows of objects in the package.

12. A machine as claimed in claim 7 wherein there are provided means operable to engage the respective vertical corner areas of the package and promote downward movement of the package material relative to the objects in said areas.

13. A machine as claimed in claim 12 wherein the means to engage the corner areas are four rotary beater units disposed so one may co-operate with each corner area of the package, each beater unit having a driven rotary carrying a plurality of flexible arms that engage the package material in the corner area and rotated in a direction to promote said downward movement.

14. A machine as claimed in claim 7 wherein the means to form the tear lines or slits and the means to engage the portion of the top wall of the package are mounted on a head frame spaced above the base so the packages may pass therebetween, said head frame being selectively movable in the vertical direction to bring each of said means to operative relation with a package supported on the base.

* * * * *